US005140899A

United States Patent [19]

Greer et al.

[11] Patent Number: 5,140,899

[45] Date of Patent: Aug. 25, 1992

[54] ANILOX ROLL MOUNTING MEANS

[75] Inventors: Larry J. Greer, Chesterfield; Robert A. Sexton, Manchester, both of Mo.

[73] Assignee: Allied Gear & Machine Company, St. Louis, Mo.

[21] Appl. No.: 753,324

[22] Filed: Aug. 30, 1991

[51] Int. Cl.[5] ..... B41F 31/14

[52] U.S. Cl. ..... 101/348; 101/216; 101/148; 101/205; 100/168; 384/256

[58] Field of Search ..... 101/148, 205-209, 101/216, 348-352, 329-331, 136, 141; 100/155 R, 168; 160/323.1-326; 118/358, 262; 384/256

[56] References Cited

U.S. PATENT DOCUMENTS 1,271,888 7/1918 Gossett et al. ..... 384/256
1,982,830 12/1934 Richter ..... 101/351
3,402,656 9/1968 Stocking ..... 100/155 R
4,233,997 11/1980 Quester et al. ..... 100/155 R X

FOREIGN PATENT DOCUMENTS 0415382 6/1925 Fed. Rep. of Germany ..... 101/350

*Primary Examiner*—Edgar S. Burr
*Assistant Examiner*—Christopher A. Bennett
*Attorney, Agent, or Firm*—Cohn, Powell & Hind

[57] ABSTRACT

This roll mounting assembly (100) for mounting an anilox roll between opposed sideframes (12) includes an anilox roll (120) and opposed end bearings (124). Each sideframe (12) includes an open ended flanged slot (130) receiving an associated bearing (124) at each end and a screw clamping assembly (140) is disposed at the other end of the slot (130) to apply a predetermined pressure to bearing (124) through the medium of a clamping pad (148).

9 Claims, 2 Drawing Sheets

FIG. 4.
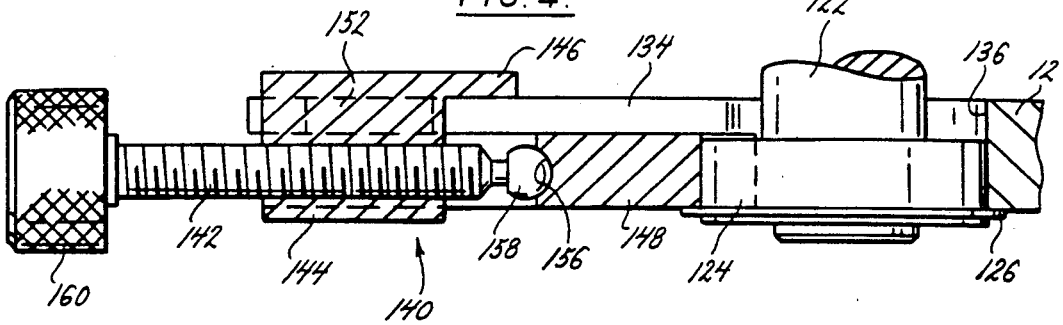
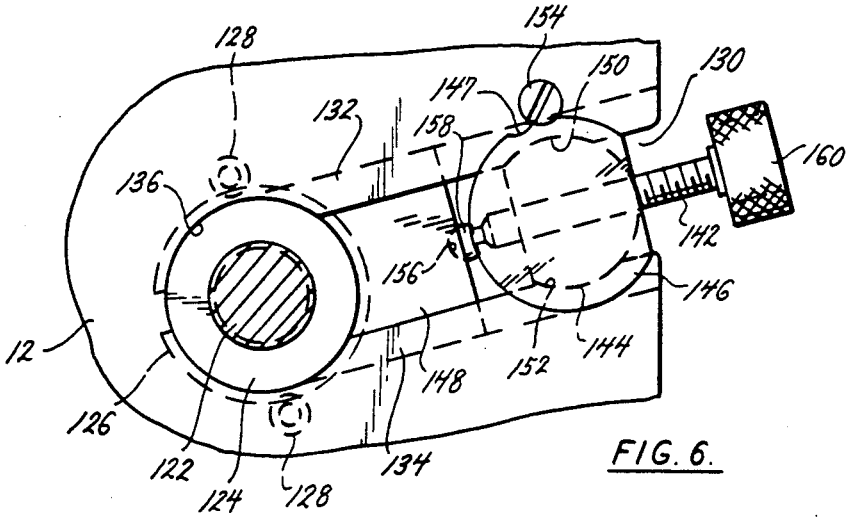
FIG. 6.
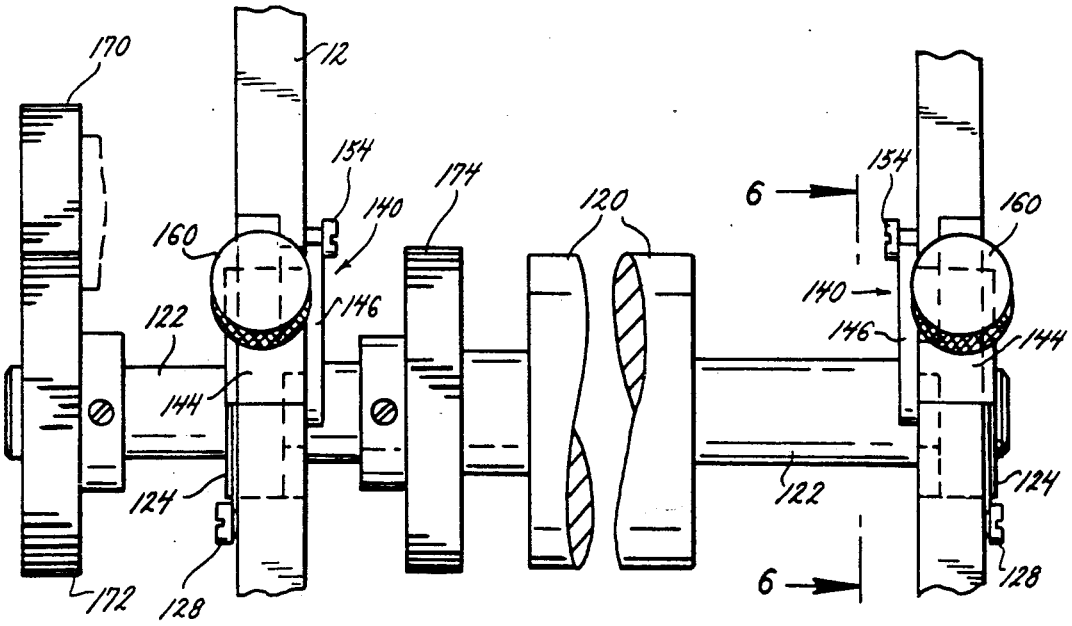
FIG. 5.

ANILOX ROLL MOUNTING MEANS

BACKGROUND OF THE INVENTION

This invention relates generally to a roll mounting means and particularly to an anilox roll mounting means for a small, relatively low cost printing press.

Printing presses and flexographic presses, in particular, are equipped with ink feed or transfer rolls which are usually referred to as anilox rolls in the flexographic printing industry. Anilox rolls are surface engraved to determine the amount of ink to be transferred in a given setup. Because of this it is necessary that the anilox roll be readily removable for replacement by another roll suitable for a different setup.

With larger printing presses removal of the roll tends to be complicated and time-consuming. In some instances, where the ink roll is virtually fixed, considerable disassembly of the press may be necessary to change the ink roll. In other instances retractable journals are used operated by cams, pneumatic or hydraulic systems in order to speed up the removal and replacement operation.

In the prior art the closest reference is believed to be U.S. Pat. application Ser. No. 07/503,240 assigned to the assignee hereof. This assembly works well for its intended purpose for use with a relatively large printing press but is not suitable for use with a relatively small and inexpensive printing press for which there is a proven need in the industry and which, to be competitive must have much simpler and less expensive parts.

The present invention supplies these requirements in a manner not disclosed in the known prior art.

SUMMARY OF THE INVENTION

There has been a need in the printing industry for a relatively small, economical flexographic printing press. In order to fill this need the present invention is one of several companion inventions which simplify particular independent features of such a press namely: a printing press register adjustment means, a printing press support structure, a meter roll mounting means and an anilox roll mounting means. The anilox roll mounting means, is disclosed herein, the other three features are disclosed in companion U.S. Pat. applications Ser. No. 07/753,071, Ser. No. 07/753,069 and Ser. No. 07/753,069, respectively, all filed Aug. 30, 1991, assigned to the assignee hereof and all incorporated herein by reference.

This invention provides an anilox roll mounting means which is particularly suitable for use with a relatively small printing press and eliminates costly and cumbersome mounting assemblies.

This combination roll and mounting assembly provides a roll including opposed ends each end having bearing means, opposed support means each including a slot means having an open outer end and a closed inner end receiving an associated bearing means, bearing retaining means retaining each bearing means in an associated slot against lateral movement, opposed clamping means including a body received in an associated slot and an adjustment member threadedly received by said body and having a remote end operatively engageable with said bearing means, and body retaining means retaining each body in place against lateral and longitudinal movement whereby said adjustment member remote end can exert a predetermined pressure operatively against said associated bearing means.

It is an aspect of this invention that said clamping means includes a pad means disposed between each adjustment member remote end and said bearing means said pad means having an arcuate bearing face conforming substantially to said bearing means.

It is another aspect of this invention to provide that said bearing retaining means includes a snap ring disposed about said bearing and engageable with said support means adjacent said slot to preclude lateral movement of said bearing means in one direction, and fastener means adjacent said snap ring and threadedly received within said support means in overlapping relation to said snap ring to retain said snap ring and preclude lateral movement of said bearing means in said other direction.

Yet another aspect of this invention is to provide that each slot includes upper and lower side flanges having arcuate bearing portions, said body includes an enlarged head portion, said body retaining means, retaining said body against longitudinal movement, is provided by engagement between said body and said arcuate bearing portions and said body retaining means, retaining said body against lateral movement in one direction, is provided by engagement between said head and said support means.

Still another aspect of this invention is to provide that fastener means connected to each said support means adjacent said slot is disposed in overlapping relation to said head and said fastener means provides said second retaining means retaining said body against lateral movement in said other direction.

It is another aspect of this invention to provide that said head includes a circumferential recess, clearance related to said fastener means, to permit lateral removal of said body when said fastener means and recess are aligned.

It is still another aspect of this invention to provide that said slots are inclined downwardly away from said open end.

It is yet another aspect of this invention to provide that each slot includes upper and lower flanges, and a clamping pad is disposed between each adjustment member remote end and said bearing means having an arcuate bearing face operatively engaging said bearing means and having an opposite face engageable by said adjustment member, said slot flanges receiving said pad means in bearing relation.

It is an aspect of this invention to provide a roll mounting assembly which is relatively inexpensive to manufacture, easy to install and highly effective in operation.

BRIEF DESCRIPTION OF THE DRAWINGS

FIG. 4 is a sectional plan view taken on line 4—4 of FIG.

FIG. 5 is an end view taken on line 5—5 of FIG. 1, and

FIG. 6 is a cross sectional view taken on line 6—6 of FIG. 5.

DESCRIPTION OF THE PREFERRED EMBODIMENT

Figure 1:
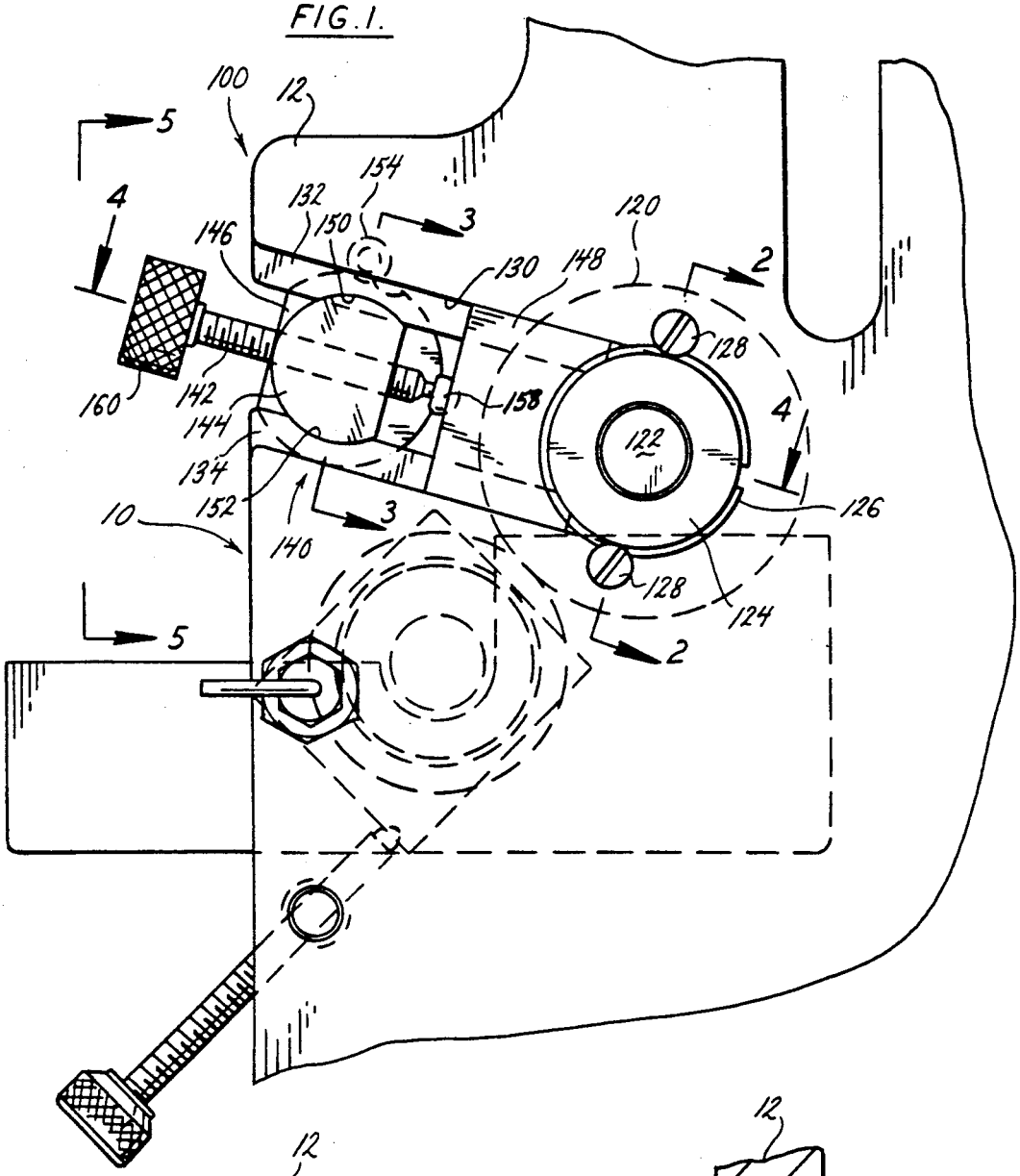
FIG. 1 is an elevational view of a printing press sideframe showing an anilox roll and a meter roll mounted thereto.

Referring now by reference numerals to the drawings and first to FIG. 1 and 5 it will be understood that a pair of opposed printing press sideframes 12 are shown which provide support for a meter roll mounting assembly 10 and an anilox roll mounting assembly 100. The meter roll mounting assembly 10 is shown in detail in U.S. Pat. application Ser. No. 07/753,406 which is assigned to the assignee of this application and is incorporated herein by reference. The anilox roll assembly 100 will now be described reference to FIGS. 1-6.

Figure 2:
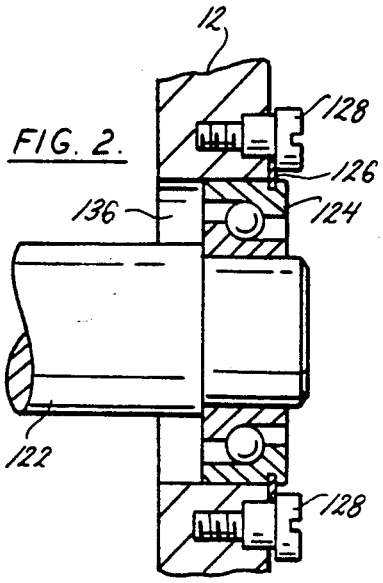
FIG. 2 is a cross sectional view taken on line 2—2 of FIG. 1.

The anilox roll mounting assembly 100 includes an anilox roll 120 having shaft ends 122 provided with bearings 124 grooved to receive snap rings 126. The sideframes 12 include opposed open-ended slots 130 having upper and lower flanges 132 and 134, said slots terminating in an end portion 136 receiving the bearings 124. The snap rings 126 engageable with an associated sideframe 12 to preclude lateral movement in one direction. Diametrically opposed fasteners 128 are threadedly connected to each sideframe in overlapping relation to the snap ring 126 to preclude lateral movement of the anilox roll 120 in the other direction as best shown in FIG. 2.

Figure 3:
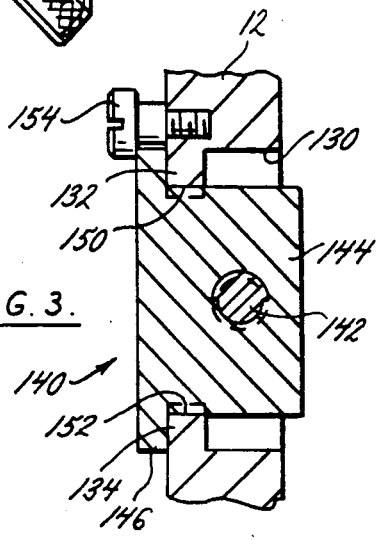
FIG. 3 is a cross sectional view taken on line 3—3 of FIG. 1.

A clamping assembly generally indicated by numeral 140 holds each of the bearings 124 in position. Each clamping assembly includes a clamping screw 142 received in threaded relation within a generally circular body 144 having a flanged head 146, and a clamping pad 148 disposed between said clamping screw 142 and said bearing 124. As shown in FIGS. 3 and 6 the body 144 is received within arcuate recessed portions 150 and 152 of the upper and lower flanges 132 and 134, which permits rotation of the body but retains said body against longitudinal movement in associated slots 130. The flanged head 146 retains said body against lateral movement in one direction, and a fastener 154, threadedly attached to each sideframe adjacent the upper portion of the slot 130 in overlapping relation to the flanged head 146, provides a retaining means precluding lateral movement of the body in the other direction. The flanged head 146 includes a circumferential recess 147, clearance related to said fastener, to permit lateral removal of said body when said fastener and recess are aligned. The clamping pad 148 is radiused at one end 149 to conform to the surface of the bearing 124 and includes a dimple 156 at the other end receiving the remote end 158 of the clamping screw 142 when rotated into position by the knob 160. The clamping screw 142, in the embodiment shown, is an adjustable torque thumb screw of the type manufactured by Carr Lane of St. Louis, MO under the designation CL-630-TSD. The knob 160 turns freely when the desired pressure is reached and a torque adjustment screw 162 is provided on the underside of the knob to predetermine the torque.

In the embodiment shown, the anilox roll 120 is driven from an impression roll (not shown) by a gear 170 which engages an end gear 172 on the anilox roll. The anilox roll 120 includes an inboard gear 174 which, in the embodiment shown, drives the meter roll 20.

It is thought that the structural features and functional advantages of this anilox roll mounting means 100 have become fully apparent from the foregoing description of parts but, for completeness of disclosure, the installation and operation will be briefly described.

The anilox roll 120, with end bearings 124 and gears 172 and 174 installed, is emplaced within associated slots 130 and positioned in the circular end 136 of the slot 130 with the snap rings 126 engaging the sideframes 12 as shown in FIG. 2. The fasteners 128 are then tightened so that the bearings 124 are laterally retained within the slots 130 in both directions. The clamping pads 148 are next emplaced within associated slots 130 using the upper and lower flanges 132 and 134 as a guide. Finally, each clamping screw body 142 is inserted into the slot recesses 150 and 152 and rotated into alignment with its associated recess 147 and pushed into place so that the flange 146 engages the sideframe 12. The body 142 can be rotated until the clamping screw remote end 158 is aligned with the dimple 156 on the end face of the pad 148. The clamping screw 142 is then screwed into place to apply a predetermined pressure to bearing 124, point pressure being avoided by the conforming face of the clamping pad bearing against the bearing 124. The use of the adjustable torque knob 160 ensures that the pressure against the bearing is not excessive.

In view of the above it will be understood that various aspects and features of the invention are achieved and other advantageous results are attained. While a preferred embodiment of the invention has been shown and described, it will be clear to those skilled in the art that various modifications may be made without departure from the invention in its broader aspects.

We claim as our invention:

1. In a combination roll and mounting assembly:

(a) a roll including opposed ends each end having bearing means, (b) opposed support means each including a slot means having an open outer end and a closed inner end, said closed end having a conforming bearing portion receiving an associated bearing means in cooperatively retained relation, (c) bearing retaining means retaining each bearing means in an associated slot against lateral movement, (d) opposed clamping means including a body received in an associated slot and an adjustment member threadedly received by said body and having a remote end operatively engageably with said bearing means, and (e) body retaining means retaining each body in place against lateral and longitudinally movement whereby said adjustment member remote end can exert a predetermined pressure operatively against said associated bearing means.

2. A mounting assembly as defined in claim 1, in which:

(f) said clamping means includes a pad means disposed between each adjustment member remote end and said bearing means said pad means having an arcuate bearing face conforming substantially to said bearing means.

3. A mounting assembly as defined in claim 1, in which:

(f) each slot includes upper and lower side flanges, having arcuate bearing portions, (g) said body includes an enlarged head portion, (h) said body retaining means, retaining said body against longitudinal movement, is provided by engagement between said body and said arcuate bearing portions and said body retaining means, retaining said body against lateral movement in one direction, is provided by engagement between said head and said support means.

4. A mounting assembly as defined in claim 3, in which:

(i) fastener means connected to each said support means adjacent said slot is disposed in overlapping relation to said head portion and said fastener means provides said body retaining means retaining said body against lateral movement in the opposite direction to said one direction.

5. A mounting assembly as defined in claim 1, in which:

(f) said slots are inclined downwardly away from said open end.

6. A mounting assembly as defined in claim 1, in which:

(f) each slot includes upper and lower flanges, and (g) a clamping pad means is disposed between each adjustment member remote end and said bearing means having an arcuate bearing face operatively engaging said bearing means nd having an opposite face engageable by said adjustment member, said slot flanges receiving said pad mean in bearing relation.

7. In a combination roll and mounting assembly;

(a) a roll including opposed ends each end having bearing means, (b) opposed support means each including a slot means having an open outer end an a closed inner end receiving an associated bearing means, (c) bearing retaining means retaining each bearing means in an associated slot against lateral movement, (d) opposed clamping means including a body received in an associated slot and an adjustment member threadedly received by said body and having a remote end operatively engageable with said bearing means, and (e) body retaining means retaining each body in place against lateral and longitudinal movement whereby said adjustment member remote end cane exert a predetermined pressure operatively against said associated bearing means, (f) said bearing retaining means including a snap ring disposed about said bearing and engageable with said support means adjacent said slot to preclude lateral movement of said bearing means in one direction, and fastener means adjacent said snap ring and threadedly received within said support means in overlapping relation to said snap ring to retain said snap ring and preclude lateral movement of said bearing means in said other direction.

8. In a combination roll and mounting assembly:

(a) a roll including opposed ends each end having bearing means, (b) opposed support means each including a slot means having an open outer end and a closed inner end receiving an associated bearing means, (c) bearing retaining means retaining each baring means in an associated slot against lateral movement, a(d) opposed clamping means including a body received in an associated slot and an adjustment member threadedly received by said body and having a remote end operatively engageable with said bearing means, and (e) body retaining means retaining each body in place against lateral and longitudinal movement whereby said adjustment member remote end can exert a predetermined pressure operatively against said associated bearing means, (f) each slot including upper nd lower side flanges, having arcuate bearing portions, (g) said body including an enlarged head portion, (h) said body retaining means, retaining said body against longitudinal movement, being provided by engagement between said body and said arcuate bearing portions and said body retaining means, retaining said body against lateral movement in one direction, being provided by engagement between said head and said support means, and (i) fastener means connected to each said support means adjacent said slot being disposed in overlapping relation to said head portion and said fastener means providing said body retaining means retaining said body against lateral movement in the opposite direction to said one direction, (j) said head portion including a circumferential recess, clearance related to said fastener means, to permit lateral removal of said body when said fastener means and recess are aligned.

9. In a combination roll and mounting assembly:

(a) a roll including opposed ends each end having bearing means, (b) opposed support means each including a slot means having an open outer end and a closed inner end having an arcuate bearing face conforming substantially to said bearing means receiving an associated bearing means in bearing engagement, (c) bearing retaining means retaining each bearing means in an associated slot against lateral movement, (d) opposed clamping means including a body received in an associated soot and an adjustment member threadedly received by said body and having a remote end operatively engageable with said baring means, said clamping means also including a pad means disposed between each adjustment member remote end and said bearing means, said pad means having an arcuate bearing face conforming substantially to said bearing means, and (e) body retaining means retaining each body in place against lateral and longitudinal movement whereby said adjustment member remote end can exert a predetermined pressure operatively against said associated bearing means through said pad means.

* * * * *